US006169465B1

(12) United States Patent
Kim et al.

(10) Patent No.: US 6,169,465 B1
(45) Date of Patent: Jan. 2, 2001

(54) DUPLEXER DIELECTRIC FILTER

(75) Inventors: Chul Ho Kim; Jin Duk Kim; Sang Jun Park, all of Kyungki-do (KR)

(73) Assignee: Samsung Electro-Mechanics Co., Ltd., Kyungki-Do (KR)

( * ) Notice: Under 35 U.S.C. 154(b), the term of this patent shall be extended for 0 days.

(21) Appl. No.: 09/212,534

(22) Filed: Dec. 16, 1998

Related U.S. Application Data

(60) Provisional application No. 60/106,372, filed on Oct. 30, 1998.

(30) Foreign Application Priority Data

Jul. 8, 1998 (KR) ..... 98-27437
Aug. 19, 1998 (KR) ..... 98-33567

(51) Int. Cl.[7] ..... H01P 1/20; H01P 7/04; H01P 5/12

(52) U.S. Cl. ..... 333/206; 333/207; 333/222; 333/134

(58) Field of Search ..... 333/202, 206, 333/222, 207, 223, 134

(56) References Cited

U.S. PATENT DOCUMENTS

| | | | | |
|---|---|---|---|---|
| 4,716,391 | | 12/1987 | Moutrie et al. . | |
| 4,740,765 | * | 4/1988 | Ishikawa et al. | 333/207 |
| 4,742,562 | | 5/1988 | Kommrusch . | |
| 4,823,098 | | 4/1989 | DeMuro et al. . | |
| 4,879,533 | | 11/1989 | de Muro et al. . | |
| 4,896,124 | * | 1/1990 | Schwent | 333/206 |

FOREIGN PATENT DOCUMENTS

| | | | | |
|---|---|---|---|---|
| 552761 A1 | * | 7/1993 | (EP) | 333/206 |
| 595623 A1 | * | 5/1994 | (EP) | 333/206 |
| 0 809 315 | | 11/1997 | (EP) . | |
| 2 273 393 | | 4/1993 | (GB) . | |
| 406069702 | * | 3/1994 | (JP) | 333/206 |
| 92/20163 | | 11/1992 | (WO) . | |
| 93/24968 | | 12/1993 | (WO) . | |

* cited by examiner

*Primary Examiner*—Robert Pascal
*Assistant Examiner*—Patricia T. Nguyen
(74) *Attorney, Agent, or Firm*—Renner Otto Boisselle & Sklar LLP

(57) ABSTRACT

A duplexer dielectric filter comprises a dielectric block, a first filtering area including resonators having resonant holes disposed to pass through first and second surfaces of the dielectric block in a substantially parallel manner, a second filtering area including resonators having resonant holes disposed to pass through the first and second surfaces of the dielectric block in a parallel manner; first conductive pattern formed on the surroundings of the resonant holes of the first surface, thus to be connected with the conductive material covered with the interior of the resonant holes and for applying a loading capacitance to the resonators and an electromagnetic coupling between adjacent resonators, a second conductive pattern disposed on the first surface of the first filtering area along the arrangement direction of the resonant hole and for forming the electromagnetic coupling between the adjacent resonators, third conductive pattern disposed on the first surface of the first filtering area for forming the electromagnetic coupling between the adjacent resonators, and fourth conductive pattern disposed on the first surface for adjusting resonant frequencies of the resonators.

21 Claims, 5 Drawing Sheets

DUPLEXER DIELECTRIC FILTER

RELATED APPLICATION DATA

This application claims priority of Provisional Application Ser. No. 60/106,372 filed on Oct. 30, 1998.

FIELD OF THE INVENTION

The present invention relates to a duplexer dielectric filter used in a mobile communication terminal equipment having high frequency band charateristics, and more particularly to the duplexer dielectric filter in which predetermined conductive patterns are formed on a first surface of a dielectric block to form an electromagnetic coupling between adjacent resonators, whereby a small and light filter can be manufactured and a resonant frequency of a resonator can be adjusted easily.

BACKGROUND OF THE INVENTION

In the duplexer dielectric filter, generally, the signal is transmitted and received simultaneously through an antenna. The duplexer filter comprises a receiving-end filter and a transmitting-end filter, the receiving-end filter has a passing characteristic for the receiving frequency and a stopping characteristics for the transmitting frequency, while the transmitting-end filter has the passing characteristics for the transmitting frequency and the stopping characteristics for the receiving frequency. This duplexer filter has to be reduced in volume for the current mobile communication equipments. For the reduced filter, the duplexer dielectric filter has been introduced.

FIG. 1 is a perspective view illustrating a conventional integrated type duplexer dielectric filter. As shown in figure, the conventional duplexer dielectric filter comprises a dielectric block 10 divided into a reception filtering area and a transmission filtering area. In this structure, the dielectric block 10 includes first and second surfaces 11 and 13 opposing to each other, a side surface 13 disposed between the first and second surfaces 11 and 13. The second surface 13 and the side surface 13, i.e., the back surface and the side surface of the dielectric block 10 are substantially covered with the the conductive materials. Furthermore, a plurality of resonant holes 30*a*–30*g* for penetrating the first and second surfaces 11 and 13 are arranged in parallel at predetermined distances from one another in the interior of the dielectric block 10. Each of the plurality of resonant holes 30*a*–30*g* is substantially covered with the conductive materials on the internal surface to thereby form a resonator.

A plurality of conductive patterns 31*a*–31*g* having predetermined size are disposed on the first surface 11 of the dielectric block 10. Each of the conductive patterns 31*a*–31*g* is connected to the conductive material covered on the interior of each resonant hole 30*a*–30*g* to apply a loading capacitance to each resonator and simultaneously to form coupling capacitance between the adjacent resonators. A resonant frequency of the resonator is determined upon the plurality of resonant holes 30*a*–30*g* and the applied loading capacitance, and the coupling of two resonators is achieved by the formation of the coupling capacitance. In addition, input and output terminals 21 and 23 made of a conductive pattern1 are disposed in the both of the first surface 11 and an antenna terminal 22 made of the conductive pattern is disposed between the reception filtering area and the transmission filtering area.

Typically, the duplexer dielectric filter has a high frequency band of the transmission filtering area relatively lower than that of the reception filtering area. Therefore, an electric field effect is predominent between the resonant holes in the reception filtering area, while a magnetic field effect is predominant between the resonant holes in the transmission filtering area. Hence, the resonant holes disposed on the reception filtering area are in a capacitance coupling relationship, and the resonant holes in the transmission filtering area are in an inductance coupling relationship.

In the above construction, determination of the resonant frequency or coupling between the resonators is dependent upon the size of the plurality of conductive patterns 31*a* to 31*g* on the first surface 11. In other words, the characteristic of the duplexer dielectric filter is dependent upon the intervals between the conductive patterns 31*a* to 31*g* and the conductive material of the side surface 12 and between the conductive patterns 31*a* to 31*g*.

To produce a small and light duplexer dielectric filter, meanwhile, the duplexer dielectric filter should be thin in thickness and the interval between the resonant holes 30*a* to 30*g* should be short in length. Since the dimension of the first surface 11 may be reduced in the miniature filter, however, there are problem that a desired attenuation characteristic can not be obtained due to limitations on the intervals between the conductive patterns 31*a* to 31*g* and the conductive material on the side surface 12 of the dielectric block 10 and between the conductive patterns 31*a* to 31*g*.

On the other hand, if the size of the dielectric block 10 is designed to be small, even in the case where the intervals between the conductive patterns 31*a* to 31*g* and the conductive material of the side surface 12 thereof and between the conductive patterns 31*a* to 31*g* are established to be short, it is impossible to reduce the volume of the dielectric block 10 in the certain limitation because of the error caused by the limitation of the printing process.

Moreover, in the case where the resonant frequency is adjusted by varying the shape of the conductive patterns 31*a* to 31*g*, since the coupling capacitance and the loading capacitance are simultaneously changed, there is a problem that the passing and stopping features for the frequency signal are indicated in an irregular order. Furthermore, there remains a problem in that since the adjusting operation of the resonant frequency is not automatic, a labour cost in the production process should be high, to thereby decrease competitiveness of the production cost.

SUMMARY OF THE INVENTION

An object of the present invention is to provide a duplexer dielectric filter having predetermined conductive patterns on a first surface of a dielectric block thereof to form a loading capacitance to a resonator, form a coupling capacitance between the adjacent resonators, and form a cross coupling capacitance between the resonator not being adjacent, whereby the duplexer dielectric filter can be small and light and be manufactured in an simplified process.

Another object of the present invention is to provide a duplexer dielectric filter having a conductive pattern for use in adjusting a resonant frequency of a resonator on a first surface of a dielectric block thereof, thus to adjust accurately a resonant frequency band to a desired band in an accurate manner.

To achieve these and other objects according to the present invention, there is provided a duplexer dielectric filter including: a dielectric block comprised of first and second surfaces opposing to each other and a side surface disposed between the first and second surfaces, the second and side surfaces being substantially covered with a conductive material; a first filtering area comprised of at least one resonator having at least one resonant hole which is disposed to pass through the first and second surfaces of the dielectric block in a substantially parallel manner and is substantially covered with the conductive material on the interior thereof and for filtering a first input signal; a second filtering area comprised of at least one resonator having at least one resonant hole which is disposed to pass through the first and second surfaces of the dielectric block in a parallel manner and is substantially covered with the conductive material on the interior thereof and for filtering a second input signal; at least one first conductive pattern formed to have a predetermined size on the surroundings of the at least one resonant hole of the first surface on which the first and second filtering areas are occupied, thus to be connected with the conductive material covered with the interior of the at least one resonant hole and for applying a loading capacitance to the at least one resonator and an electromagnetic coupling between the adjacent resonators; input/output terminals each comprised of an electrode area isolated from the conductive material of the side surface of the dielectric block and for forming an electromagnetic coupling with the resonant holes; an antenna terminal comprised of an electrode area isolated from the conductive material of the side surface of the dielectric block and disposed between the first and second filtering areas of the dielectric block to thereby form the electromagnetic coupling with the resonator; at least one second conductive pattern disposed on any one of the top and bottom portions of the first surface of the first filtering area of the dielectric block, along with the arranged direction of the resonant hole thereof and for forming the electromagnetic coupling between the adjacent resonators; at least one third conductive pattern disposed on the first surface of the first filtering area of the dielectric block, for forming the electromagnetic coupling between the adjacent resonators; and at least one fourth conductive pattern disposed on the first surface of the dielectric block, for adjusting a resonant frequency of the resonator.

BRIEF DESCRIPTION OF THE DRAWINGS

Other objects and aspects of the invention will become apparent from the following description of embodiments with reference to the accompanying drawing in which.

DETAILED DESCRIPTION OF THE PREFERRED EMBODIMENT

Hereinafter, an explanation on the construction of a duplexer dielectric filter according to a preferred embodiment of the present invention will be discussed in detail accompanying drawings.

Figure 1:
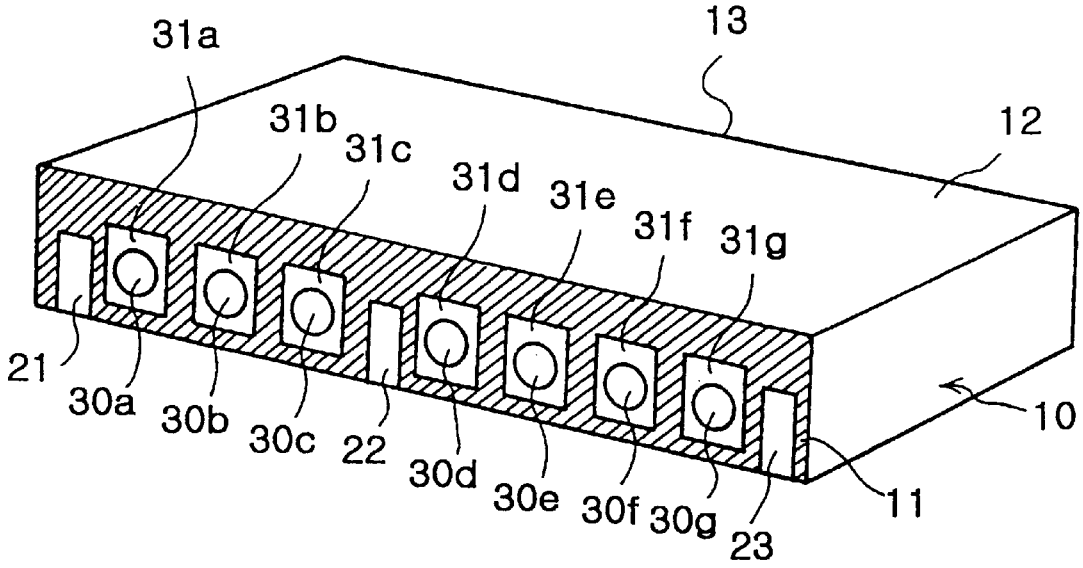
FIG.1 PRIOR ART
FIG. 1 is a perspective view illustrating a conventional integrated type duplexer dielectric filter.
Figure 2:
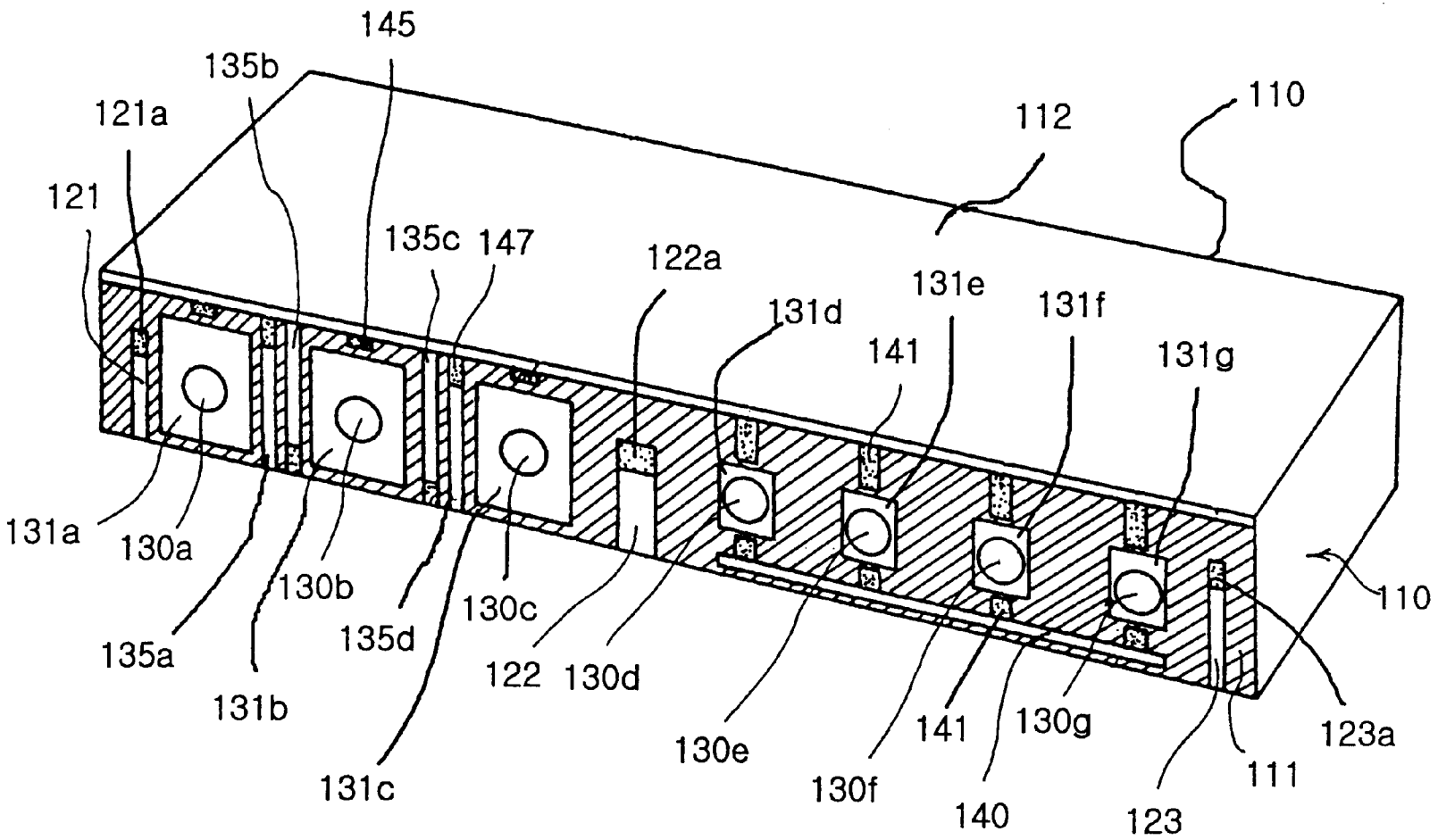
FIG. 2 is a perspective view illustrating a duplexer dielectric filter constructed according to the principles of the present invention.

FIG. 2 is a perspective view illustrating a duplexer dielectric filtered according to the present invention. As shown in figure, the duplexer dielectric filter includes a hexahedral dielectric block 110, in which first and second surfaces 111 and 113 are opposed to each other. The dielectric block 100 has a plurality of resonant holes 130*a* to 130*g* penetrating parallel the first and second surface 111 and 113 in the predetermined distance from one another. A conductive material is covered on the second surface 113 and a side surface 112 disposed between the first and second surfaces 111 and 113, respectively, thus to form a ground electrode. Also, the conductive material is covered on the internal surfaces of the plurality of resonant holes 130*a* to 130*g*, each resonant hole forming a resonator. On the other hand, an open area on which the conductive material is not covered is formed on the first surface 111 of the dielectric block 110.

At least one first conductive patterns 131*a* to 131*g* are formed on the surroundings of the plurality of resonant holes 130*a* to 130*g* of the first surface 111 in predetermined size, thus to be connected with an internal electrode on the internal surface of each resonant hole and apply a loading capacitance to each resonator and an electromagnetic coupling between the adjacent resonators. Additionally, transmitting and receiving terminals 121 and 123 and an antenna terminal 122 are formed on the first surface 111 of the dielectric block 110.

Not shown in figure, on the side surface 112 of the dielectric block 110 are formed input/output pads and an antenna pad which are isolated from the conductive material and input/output a signal from/to a substrate in which the dielectric block 110 is mounted. These pads are connected to the input/output terminals 121 and 123 and the antenna terminal 122, respectively. Accordingly, the input/output terminals 121 and 123 and the antenna terminal 122 as described in the preferred embodiment of the present invention each contain the input/output pads and the antenna pad which are formed in the general duplexer dielectric filter.

The duplexer dielectric filter is typically made of first and second filtering areas. If the first filtering area is filtering a receiving signal through the antenna terminal, the second filtering area is filtering the transmitting signal through the antenna terminal. Generally, there is no need to divide the reception filtering area and the transmission filtering area within the dielectric block. Even in case of the duplexer dielectric filters having the same structure system, the reception filtering area and the transmission filtering area can be changed in accordance with a specific product. Therefore, the transmission/reception filtering areas in the preferred embodiment of the present invention can be divided for the convenience of an explanation, which of course does not limit the scope of the present invention.

In the dielectric filter as shown in FIG. 2, three resonant holes, which are disposed on the left side centering around the antenna terminal 122, are involved in the transmission filtering area occupied for outputting a high frequency signal, and four resonant holes, which are disposed on the right side, are involved in the reception filtering area occupied for inputting the high frequency signal. The reception filtering area has the passing characteristics for the receiving frequency and the stopping characteristics for the transmitting frequency. To the contrary, the transmission filtering area has the passing characteristics for the transmitting frequency and stopping characteristics for the receiving frequency.

At least one second conductive pattern 140 of a strip line shape is disposed on the lower portion of resonant holes 130*d* to 130*g* in the reception filtering area of the first surface 111, along arrangement direction of the plurality of resonant holes 130*d* to 130*g* in a predetermined distance from the first conductive patterns 131*d* to 131*g*. The second conductive pattern 140 is adapted to form a coupling capacitance between the adjacent resonators and a cross coupling capacitance between the resonators to be not adjacent, respectively, thus to determine a frequency band of the reception filtering area.

The second conductive pattern 140 may be disposed on the top portion or on both the top and bottom portions of the resonant holes 130*d* to 130*g*, along with the arrangement direction of the resonant holes 130*d* to 130*g*. The position of the second conductive pattern 140 has no influence on the degree of the coupling and cross-coupling capacitance formed. If the second conductive pattern 140 is disposed on both the lower and upper portions of the resonant holes 130*d* to 130*g*, respectively, it can form a larger degree of coupling capacitance, to thereby decrease the size of each of the first conductive patterns 131*d* to 131*g*.

The strip line shaped second conductive pattern 140 has predetermined length and width, and the coupling capacitance increases as the predetermined length and width thereof increase. The second conductive pattern 140 is connected to the ground electrode on the side surface 112 of the dielectric block 110, but is preferably short-circuited therewith.

At least one third conductive pattern 141, which is formed on the upper portion of the resonant holes 130*d* to 130*g* in the reception filtering area, is extended toward the resonant holes 130*d* to 130*g* from the ground electrode of the dielectric block 110. The third conductive pattern 141 is adapted to adjust the resonant frequency which is varied in accordance with the length and width thereof. The third conductive pattern 141 is integrated with the second conductive pattern 140 which is formed on the lower portion of the resonant holes 130*d* to 130*g*, as shown in FIG. 2 and can be extended toward the resonant holes 130*d* to 130*g*. The third conductive pattern 141 for adjusting the resonant frequency may be formed on the upper or lower portion of the resonant holes 130*d* to 130*g*, independing on the second conductive pattern 140.

The third conductive pattern 141, which is disposed on the upper portion of the resonant holes 130*d* to 130*g*, is connected to the ground electrode on the side surface 112 of the dielectric block 110, thus to be extended toward the resonant holes 130*d* to 130*g*, but may be short-circuited to the ground electrode. Furthermore, the third conductive pattern 141 is disposed on the one side of the length direction of the second conductive pattern 140 and may be disposed on the both sides thereof. The arrangement position of the third conductive pattern 141 for adjusting the resonant frequency is not be fixed as mentioned above.

The transmitting/receiving terminals 121 and 123 and the antenna terminal 122 each include length adjusting areas 121*a*, 122*a* and 123*a* on the end portions thereof. The length adjusting areas 121*a*, 122*a* and 123*a* are occupied to adjust the length of the transmitting/receiving terminals 121 and 123 and the antenna terminal 122 respectively to control an electromagnetic coupling with the resonant holes 130*a* to 130*g*.

Strip shaped fourth conductive patterns 135*a* to 135*d* are each formed between the resonant holes 130*a* to 130*c* of the transmission filtering area. In more detail, in a state separated at a predetermined distance from the first conductive patterns 131*a* to 131*c*, the fourth conductive patterns 135*a* and 135*b* are disposed between the adjacent resonant holes 130*a* and 130*b* and the fourth conductive patterns 135*c* and 135*d* between the adjacent resonant holes 130*b* and 130*c* thereto. The fourth conductive patterns 135*a* to 135*d* are connected to the ground electrode of the side surface 112 of the dielectric block 110. The fourth conductive patterns 135*a* to 135*d* suppress the capacitance between the resonant holes 130*a* to 130*c* and to form a coupling capacitance to thereby form an attenuation pole at a frequency band higher than pass-band of the dielectric filter. Accordingly, each of the fourth conductive patterns 135*a* to 135*d* forms a length adjusting area 147 on the end portion thereof, so that each pattern 135*a* to 135*d* can adjust its own length to thereby adjust the frequency where the attenuation pole is formed. At this time, the two length adjusting areas 147 each are respectively formed on the opposing end portions of the fourth conductive patterns. In other words, if one length adjusting area 147 is formed at the upper end portion of one conductive pattern, the other is formed at the lower portion of the adjacent pattern.

A fifth pattern 145 for adjusting the resonant frequency of the resonator, which is disposed on the upper portion of the resonant holes 130*a* to 130*c* in the transmission filtering area, is extended toward the resonant holes 130*a* to 130*c* from the ground electrode on the side surface 112 of the dielectric block 110, in the same manner as the reception filtering area. At this time, the fifth pattern 145 may be short-circuited with the ground electrode of the side surface 112 and may be formed on the upper and lower portions of the resonant holes 130*a* to 130*c*.

Hereinafter, an explanation of the operation and effect of the duplexer dielectric filter according to the present invention will be discussed.

As shown in FIG. 2, the transmission filtering area on the left side of the antenna 122 is occupied to transmit the high frequency, and the reception filtering area on the right side of the antenna 122 is occupied to receive the high frequency. At this time, the plurality of resonant holes 130*a* to 130*g*, which are in parallel disposed on the transmission and reception filtering areas, are separated by predetermined intervals from each other, each acting as a resonator having quarter-wavelength(λ).

Figure 3:
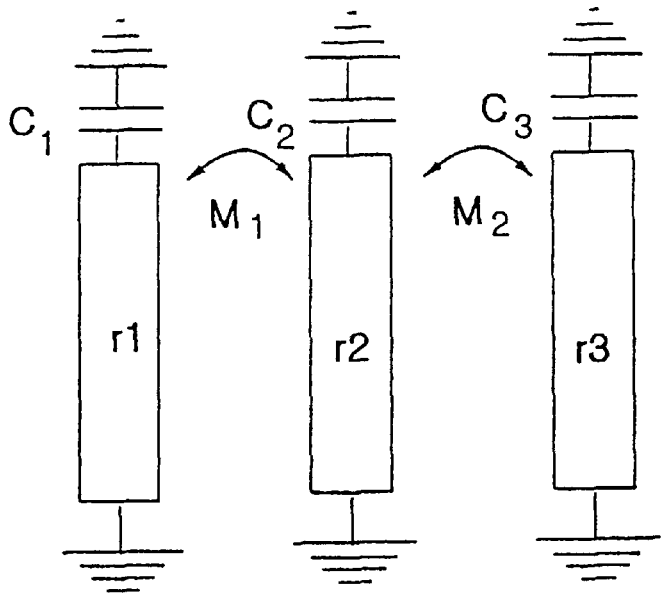
FIG. 3 is an equivalent circuit diagram of a transmission filtering area of FIG. 2.

FIG. 3 is an equivalent circuit diagram of a transmission filtering area of FIG. 2. The filtering feature of the transmission filtering area is embodied by adjusting the loading capacitance C1, C2 and C3. Existence of the loading capacitance C1, C2 and C3 allows a resonance point to be formed at a lower frequency than the resonant frequency of each resonator r1, r2 and r3. This means the length of each resonator r1 to r3 is shorter than the quarter-wavelength(λ) of the resonance point. In this case, since the coupling by the electric field between the resonators is suppressed, coupling effect by the magnetic field therebetween is predominant. Hence, induction coupling M1 and M2 are each formed between the resonators.

Contrarily, since the quarter-wavelength may be shortened at the frequency higher than the frequency in the pass-band, the predominated magnetic coupling effect is gradually reduced. If the frequency reaches a specific frequency, the coupling effect is finally at a transmission-zero state and an attenuation pole is formed. Under the principles as mentioned above, the attenuation pole, which is formed on the high frequency of the transmitting end pass-band, is adjusted by a proper adjustment of the loading capacitance C1 to C3.

To this end, in the duplexer dielectric filter of the present invention, in the case where the loading capacitance C1 to C3 is adjusted to regulate the characteristic of the filter during the design or production process, the length of each fourth conductive pattern 135*a* to 135*d* and the fifth conductive pattern 145 is adjusted. At this time, if only the single fourth conductive pattern is formed, the conductive pattern can adjust the loading capacitance in accordance with the variation of length of the electrode, but at the same time the coupling capacitance between the resonant holes is varied, so the adjustment variables are increased and the tuning thereof becomes difficult. Therefore, there is a need to dispose a pair or more of the fourth conductive patterns, as shown in FIG. 2.

Therefore, one pair or more of the fourth conductive patterns 135*a* to 135*d* are provided and the length adjusting area 147 is arranged in the direction that the ground electrodes of the fourth conductive patterns 135*a* to 135*d* crosses each other, such that the variables caused by the capacitance coupling between the resonant holes can be reduced to thereby perform the adjustment of the resonant frequency in a simple manner, which improves the efficiency of the frequency adjustment operation.

Figure 4:
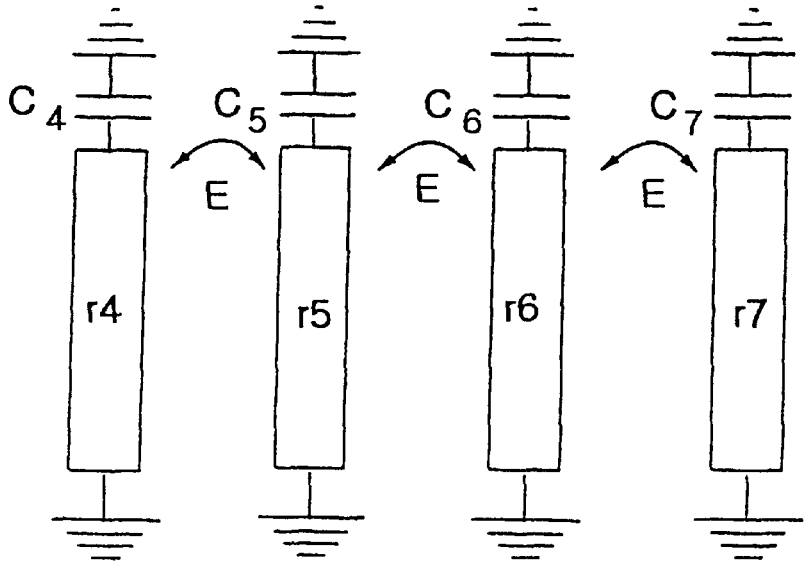
FIG. 4 is an equivalent circuit diagram of a reception filtering area of FIG. 2.

In the meanwhile, the reception filtering area in the dielectric block 110 of the duplexer dielectric filter includes the resonant holes 130*d* to 130*g* and the second conductive pattern 140 which is formed in the surroundings of the resonant holes 130*d* to 130*g*. The reception filtering area has a reduced loading capacitance since the pass-band frequency of the reception area is higher than that of the transmission area. Moreover, the reception filtering area should have a stop-band for a low frequency within the pass-band, when compared with the transmission area. At this time, in the case where the frequency becomes low, the quarter-wavelength is lengthened to thereby increase the coupling by the magnetic field between the resonant holes 130*d* to 130*g*. Therefore, as compared with the transmission filtering area, the reception filtering area should increase the coupling capacitance to offset the coupling effect at the low frequency, thereby forming the attenuation pole. FIG. 4 shows the equivalent circuit diagram of the reception filtering area of the dielectric block 110, in which the electric field coupling between the resonators r4 to r7 is predominant in the case where the coupling capacitance between the resonators r4 to r7 is increased.

In the reception filtering area of the present invention, the second conductive pattern 140, which is formed on the lower portion of the resonant holes 130*d* to 130*g*, not to be connected with the ground electrode of the side surface 112 of the dielectric block 110, serves to suppress the loading capacitance of the resonant holes 130*a* to 130*g* and to increase the coupling capacitances between the adjacent resonants to each other and between the resonants not being adjacent to each other. In addition, the third conductive pattern 141 within the reception filtering area serves to perform the adjustment of the resonant frequency in an easy manner.

Figure 5:
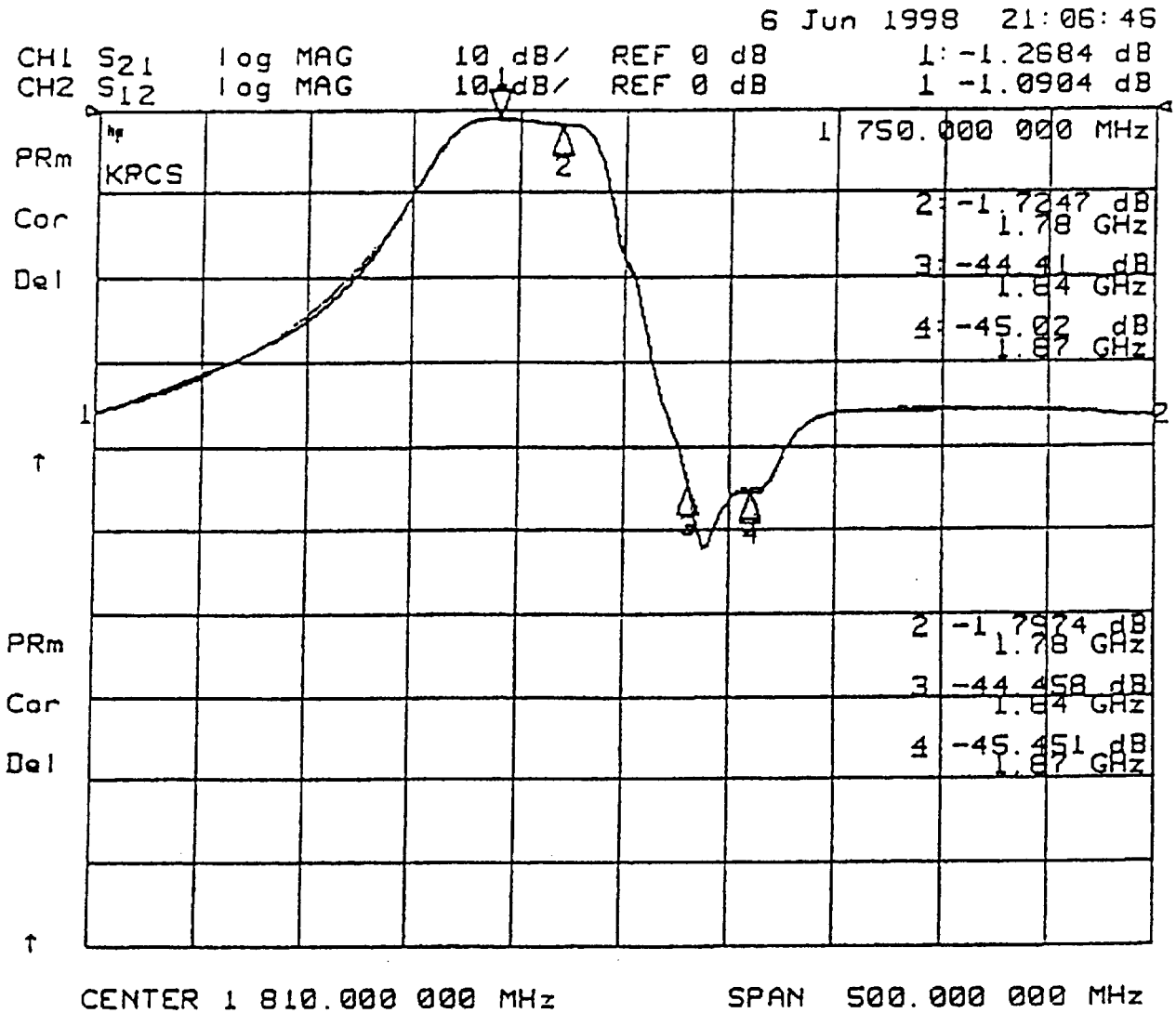
FIG. 5 is a characteristic graph of the transmission filtering area of the duplexer dielectric filter of FIG. 2.
Figure 6:
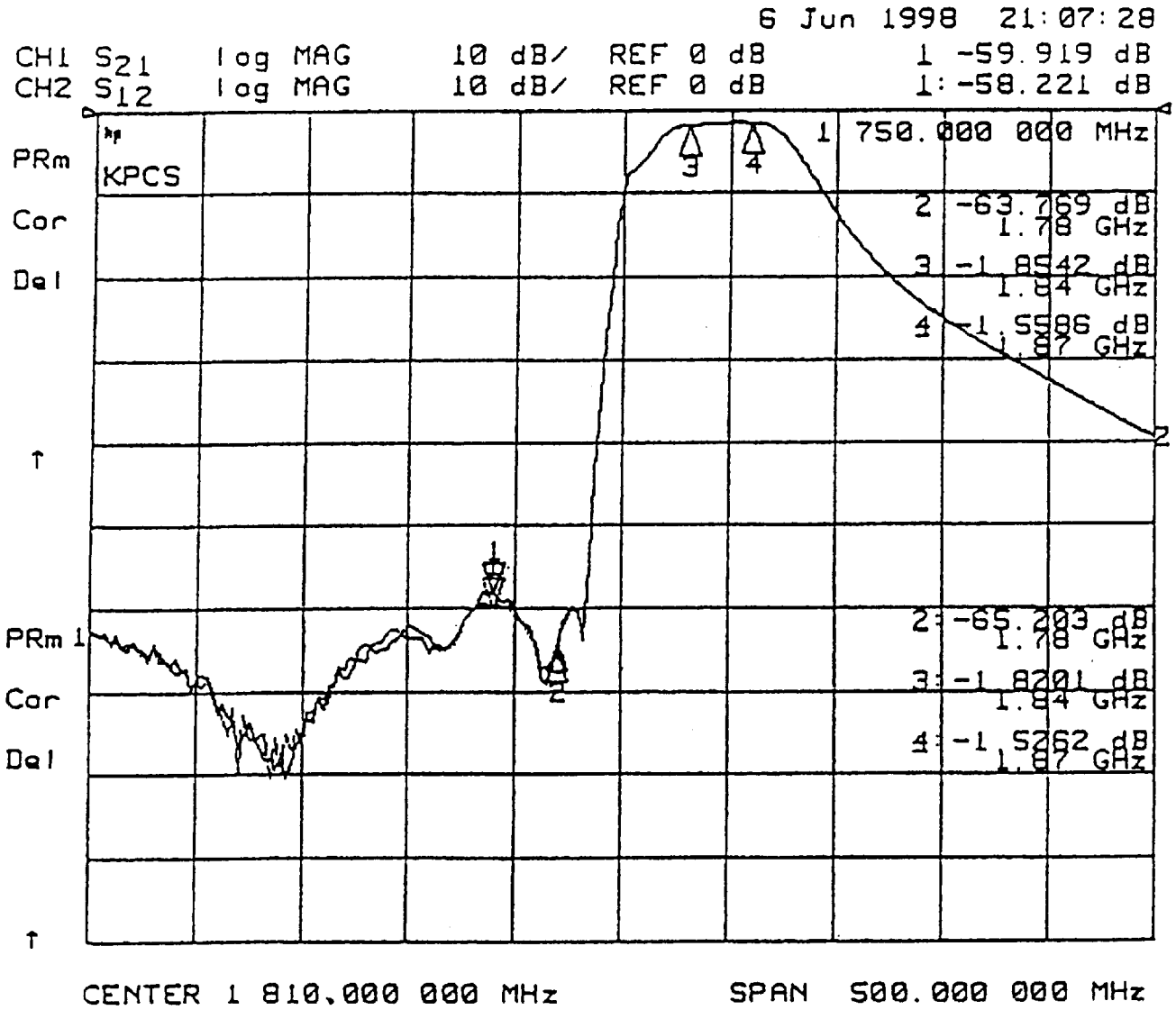
FIG. 6 is a characteristic graph of the reception filtering area of the duplexer dielectric filter of FIG. 2.

FIG. 5 is a characteristic curve of the transmission filtering area of the duplexer dielectric filter according to the present invention, and FIG. 6 is a characteristic curve of the reception filtering area of the duplexer dielectric filter according to the present invention. As shown in FIGS. 5 and 6, in the transmission filtering area of the duplexer dielectric filter, the attenuation ratio is obtained at the high frequency within the pass-band, and in the reception filtering area of the duplexer dielectric filter, the attenuation ratio is obtained at the low frequency within the pass-band. This is accomplished by the adjustment of the length of the fourth conductive patterns 135*a* to 135*d* and the fifth conductive pattern 145 in the transmission filtering area and by the adjustment of the length of the second and third conductive patterns 140 and 141.

While the present invention has been described with reference to a specific embodiment, the description is illustrative of the invention and is not to be construed as limiting the invention. However, various modifications may occur to those skilled in the art, without departing from the spirit and scope of the present invention.

As discussed in the above, a duplexer dielectric filter according to the present invention can perform in an easy manner adjustment of loading capacitance and coupling capacitance for a plurality of resonant holes by varying the length of a predetermined portion of the electrode of each predetermined conductive pattern, and particularly, perform a separate adjustment for the loading and coupling capacitance to thereby execute control of frequency band and a resonant frequency.

Furthermore, a duplexer dielectric filter according to the present invention can perform adjustment of a resonant frequency in a simple manner to thereby ensure the improvement of product productivity and cost saving in design and manufacturing processes, which will result in the advancement of cost competitiveness thereof.

What is claimed is:

1. A duplexer dielectric filter, comprising:

a dielectric block including first and second surfaces facing to each other and a side surface disposed between said first and second surfaces, said second and side surfaces being substantially covered with a conductive material;

a receiving area having a plurality of resonators formed by respective resonant holes which are disposed to pass between said first and second surfaces of said dielectric block in a substantially parallel manner and are substantially covered with said conductive material on the interior thereof and for filtering a first input signal, said receiving area having a first conductive pattern on the first surface to form an electromagnetic coupling between said resonators;

a transmitting area having a plurality of resonators formed by respective resonant holes which are disposed to pass between said first and second surfaces of said dielectric block in a substantially parallel manner and are substantially covered with said conductive material on the interior thereof and for filtering a second input signal, said transmitting area having a first conductive pattern on the first surface to form an electromagnetic coupling between said resonators;

input/output terminals each including an electrode area isolated from said conductive material on the side surface of said dielectric block and for forming an electromagnetic coupling with a respective resonant hole;

an antenna terminal having an electrode area isolated from said conductive material on the side surface of said dielectric block and disposed between said first and second filtering areas of said dielectric block to thereby form an electromagnetic coupling with a respective said resonator of said receiving and transmitting areas; and at least one second conductive pattern formed on said first surface of said dielectric block, along an arrangement direction of said resonant holes, for strengthening a coupling capacitance between adjacent resonators and for forming a cross coupling capacitance between non-adjacent resonators.

2. The filter according to claim 1, wherein said second conductive pattern is is disposed above or below said resonant holes.

3. The filter according to claim 1, wherein said second conductive pattern is formed to be extended through at least two resonant holes.

4. The filter according to claim 3, wherein said second conductive pattern is formed to be extended to end portions of said at least two resonant holes.

5. The filter according to claim 1, wherein said first conductive pattern includes at least one conductive pattern formed on said first surface and surrounding a respective resonant hole and connected with said conductive material covering the interior of said respective resonant hole, for applying a loading capacitance to the respective resonator and an electromagnetic coupling with adjacent resonators.

6. The filter according to claim 1, wherein said first conductive pattern includes at least one conductive pattern which is disposed between end portions of said resonant holes on said first surface of said dielectric block, for forming said electromagnetic coupling with adjacent resonators.

7. The filter according to claim 6, wherein said first conductive pattern is connected with said conductive material on the side surface of said dielectric block on one end portion thereof.

8. The filter according to claim 6, wherein said first conductive pattern is connected with said conductive material on the side surface of said dielectric block on both end portions thereof.

9. The filter according to claim 6, wherein said first conductive pattern includes at least two conductive patterns which are formed to be spaced at a predetermined distance relative to each other between the end portions of said resonant holes, each said pattern being connected with said conductive material on the side surface of said dielectric block on one end portion thereof.

10. The filter according to claim 6, wherein said first conductive pattern comprises a length adjusting area which is disposed on the end portion thereof, for adjusting an electromagnetic coupling between the adjacent resonators as length thereof is adjusted.

11. The filter according to claim 6, wherein said first conductive pattern is formed to be integrated with said second conductive pattern.

12. The filter according to claim 1, further comprising at least one third conductive pattern for adjusting a resonant frequency and which is disposed on said first surface of said dielectric block, for adjusting a resonant frequency of said resonator.

13. The filter according to claim 12, wherein said third conductive pattern is formed to be extended from said conductive material on the side surface of said dielectric block toward the end portion of said resonant hole at said first surface.

14. The filter according to claim 12, wherein said third conductive pattern adjusts the resonant frequency by adjustment of an area thereof and a distance between the end portion of said resonant hole and said third conductive pattern.

15. The filter according to claim 12, wherein said third conductive pattern is formed to be extended from said second conductive pattern toward the end portion of said resonant hole at said first surface.

16. The filter according to claim 12, wherein said third conductive pattern is formed to be extended from said second conductive pattern toward said side surface of said dielectric block.

17. The filter according to claim 1, wherein said input/output terminals and said antenna terminal each comprise a length adjusting area which is formed on each end portion thereof, for controlling the electromagnetic coupling with said resonant hole.

18. A duplexer dielectric filter, comprising:

a dielectric block including first and second surfaces facing to each other and a side surface disposed between said first and second surfaces, said second and side surfaces being substantially covered with a conductive material;

a receiving area having a plurality of resonators formed by respective resonant holes which are disposed to pass between said first and second surfaces of said dielectric block in a substantially parallel manner and are substantially covered with said conductive material on the interior thereof and for filtering a first input signal, said receiving area having a first conductive pattern on the first surface to form an electromagnetic coupling between said resonators;

a transmitting area having a plurality of resonators formed by respective resonant holes which are disposed to pass between said first and second surfaces of said dielectric block in a substantially parallel manner and are substantially covered with said conductive material on the interior thereof and for filtering a second input signal, said transmitting area having a first conductive pattern on the first surface to form an electromagnetic coupling between said resonators;

input/output terminals each including an electrode area isolated from said conductive material on the side surface of said dielectric block and for forming an electromagnetic coupling with a respective resonant hole;

an antenna terminal having an electrode area isolated from said conductive material on the side surface of said dielectric block and disposed between said first and second filtering areas of said dielectric block to thereby form an electromagnetic coupling with a respective said resonator of said receiving and transmitting areas; and at least one second conductive pattern disposed at a predetermined distance from the end portion of each of said plurality of resonant holes on said first surface of said dielectric block, and along an arrangement direction of said resonant holes, for strengthening a coupling capacitance between adjacent resonators and for forming a cross coupling capacitance between the non-adjacent resonators.

19. A duplexer dielectric filter, comprising:

a dielectric block including first and second surfaces facing to each other and a side surface disposed between said first and second surfaces, said second and side surfaces being substantially covered with a conductive material;

a receiving area having a plurality of resonators formed by resonant holes which are disposed to pass between said first and second surfaces of said dielectric block in a substantially parallel manner and are substantially covered with said conductive material on the interior thereof and for filtering a first input signal, said receiving area including a first conductive pattern on the first surface to form an electromagnetic coupling between resonators, said first conductive pattern having a length adjusting area for adjusting the electromagnetic coupling between the adjacent resonators, the length adjusting area being disposed on an end portion of said first conductive pattern;

a transmitting area having a plurality of resonators formed by respective resonant holes which are disposed to pass between said first and second surfaces of said dielectric block in a substantially parallel manner and are substantially covered with said conductive material on the interior thereof and for filtering a second input signal, said transmitting area having a first conductive pattern on the first surface to form an electromagnetic coupling between said resonators;

input/output terminals each including an electrode area isolated from said conductive material on the side surface of said dielectric block and for forming an electromagnetic coupling with a respective resonant hole;

an antenna terminal having an electrode area isolated from said conductive material on the side surface of said dielectric block and disposed between said first and second filtering areas of said dielectric block to thereby form an electromagnetic coupling with a respective said resonator of said receiving and transmitting areas; and at least one second conductive pattern formed on said first surface of said dielectric block, along an arrangement direction of said resonant holes, for strengthening a coupling capacitance between adjacent resonators and for forming a cross coupling capacitance between the non-adjacent resonators.

20. A duplexer dielectric filter, comprising:

a dielectric block including first and second surfaces facing to each other and a side surface disposed between said first and second surfaces, said second and side surfaces being substantially covered with a conductive material;

a receiving area having a plurality of resonators formed by resonant holes which are disposed to pass between said first and second surfaces of said dielectric block in a substantially parallel manner and are substantially covered with said conductive material on the interior thereof and for filtering a first input signal, said receiving area including a first conductive pattern on the first surface to form an electromagnetic coupling between resonators;

a transmitting area having a plurality of resonators formed by respective resonant holes which are disposed to pass between said first and second surfaces of said dielectric block in a substantially parallel manner and are substantially covered with said conductive material on the interior thereof and for filtering a second input signal, said transmitting area having a first conductive pattern on the first surface to form an electromagnetic coupling between said resonators;

input/output terminals each including an electrode area isolated from said conductive material on the side surface of said dielectric block and for forming an electromagnetic coupling with a respective resonant hole;

an antenna terminal having an electrode area isolated from said conductive material on the side surface of said dielectric block and disposed between said first and second filtering areas of said dielectric block to thereby form an electromagnetic coupling with a respective said resonator of said receiving and transmitting areas; and at least one second conductive pattern formed on said first surface of said dielectric block, along an arrangement direction of said resonant holes, for strengthening a coupling capacitance between adjacent resonators and for forming a cross coupling capacitance between the non-adjacent resonators; and at least one third conductive pattern for adjusting a resonant frequency which is disposed on said first surface of said dielectric block, for adjusting a resonant frequency of said resonator.

21. A duplexer dielectric filter, comprising:

a dielectric block including first and second surfaces facing to each other and a side surface disposed between said first and second surfaces, said second and side surfaces being substantially covered with a conductive material;

a receiving area having a plurality of resonators formed by resonant holes which are disposed to pass between said first and second surfaces of said dielectric block in a substantially parallel manner and are substantially covered with said conductive material on the interior thereof and for filtering a first input signal, said receiving area including a first conductive pattern on the first surface to form an electromagnetic coupling between resonators;

a transmitting area having a plurality of resonators formed by respective resonant holes which are disposed to pass between said first and second surfaces of said dielectric block in a substantially parallel manner and are substantially covered with said conductive material on the interior thereof and for filtering a second input signal, said transmitting area having a first conductive pattern on the first surface to form an electromagnetic coupling between said resonators;

input/output terminals each including an electrode area isolated from said conductive material on the side surface of said dielectric block and for forming an electromagnetic coupling with a respective resonant hole, said input/output terminals including a length adjusting area for controlling the electromagnetic coupling with said respective resonant hole, the length adjusting area being formed on each end portion of said input/output terminals;

an antenna terminal having an electrode area isolated from said conductive material on the side surface of said dielectric block and disposed between said first and second filtering areas of said dielectric block to thereby form an electromagnetic coupling with a respective said resonator of said receiving and transmitting areas, said antenna terminal including a length adjusting area for controlling the electromagnetic coupling with said respective resonant hole, the length adjusting area being formed on each end portion of said input/output terminals; and at least one second conductive pattern formed on said first surface of said dielectric block, along an arrangement direction of said resonant holes, for strengthening a coupling capacitance between adjacent resonators and for forming a cross coupling capacitance between the non-adjacent resonators.

* * * * *